United States Patent [19]

Mastman

[11] 4,146,154

[45] Mar. 27, 1979

[54] HAND-ACTUATED LIQUID DISPENSER

[76] Inventor: Gary J. Mastman, 5150 Graves Ave., San Jose, Calif. 95129

[21] Appl. No.: 852,139

[22] Filed: Nov. 16, 1977

Related U.S. Application Data

[63] Continuation of Ser. No. 683,628, May 5, 1976, abandoned.

[51] Int. Cl.[2] ..... B67D 1/16

[52] U.S. Cl. ..... 222/109; 222/205

[58] Field of Search ..... 128/224, 225, 230, 232, 128/251, 252; 222/206, 207, 211, 109-111, 205

[56] References Cited

U.S. PATENT DOCUMENTS

| | | | |
|---|---|---|---|
| 2,774,517 | 12/1956 | Teegardin et al. | 222/205 |
| 3,246,807 | 4/1966 | Micallef | 222/207 |
| 3,263,871 | 8/1966 | Thompson | 222/205 |
| 3,744,678 | 7/1973 | Beres et al. | 222/205 |

FOREIGN PATENT DOCUMENTS

| | | | |
|---|---|---|---|
| 2429626 | 1/1976 | Fed. Rep. of Germany | 222/205 |
| 42-13658 | 8/1967 | Japan | 222/205 |

*Primary Examiner*—Stanley H. Tollberg

*Attorney, Agent, or Firm*—Townsend and Townsend

[57] ABSTRACT

A dispenser for liquids such as liquid soap or the like, wherein a container having a collapsible sidewall is coupled to a dispensing member mounted on the upper open end of the container. A tube places the container in fluid communication with a tubular passage at the lower end of the member. One embodiment of the member is funnel-shaped and has an open top for engagement by the hand for collapsing of the sidewall as the hand taps or forces the member downwardly to force liquid through the tube, into the interior of the member and onto the hand in a jet or spurt action, the excess liquid dripping from the hand back into the container through the tube. Another embodiment of the member is a laterally extending tube having a nozzle at its outer end. Several embodiments of the funnel-shaped member can be integral with each other if molded in a single process.

10 Claims, 10 Drawing Figures

HAND-ACTUATED LIQUID DISPENSER

This is a continuation of application Ser. No. 683,628, filed May 5, 1976 now abandoned.

This invention relates to improvements in the containment and dispensing of liquids and, more particularly, to an improved liquid dispenser having means for conserving liquid.

BACKGROUND OF THE INVENTION

Most soap dispensers have generally been of the type in which an inverted, well-mounted liquid container has a valve at the lower end thereof so that, by applying hand pressure upwardly on the valve, a charge of liquid soap gravitates from the container into the hand held beneath the valve. Usually this charge is more soap than is actually required to form the lather for washing the hands. Also, there is a certain amount of waste because the valve oftentimes does not properly close, thereby allowing some of the soap to drip out of the container since the latter at all times is inverted. A need has, therefore, arisen for an improved liquid dispenser which does not have to be mounted on a wall and which dispenses liquids in a manner such that they are not wasted.

A review of liquid dispensers has developed the following U.S. Pat. Nos.: 721,112; 2,554,658; 2,599,446; 2,738,107; 2,752,069; and 3,705,668. None of these references discloses structure suitable for use as a liquid dispenser to fill the above need. For the most part, these references are limited to squeeze-bottle features or oil can concepts, none of which would be of practicality in dispensing of liquid in a manner to prevent waste.

SUMMARY OF THE INVENTION

The present invention is directed to an improved liquid dispenser suitable for dispensing liquids of different types but especially liquid soap. To this end, the invention utilizes a container having a corrugated sidewall which allows the latter to collapse and to decrease the volume of the container itself. When so collapsed, the container allows liquid therein to be forced upwardly through a generally upright tube and into a dispensing member covering the open top of the container.

In one form, the dispensing member is conical and has an upper, open end surrounded by a rim which is engaged by the hand, palm down, to force the member slightly downwardly and thereby to collapse the sidewall to initiate the travel of the liquid soap up through the tube and into the member. The liquid is caused to jet or spurt up from the tube through the member and, as it does, it contacts the palm of the hand to wet the same so that a portion of the liquid will remain by surface tension on the hand while the excess liquid will return by gravity to the inner surface of the member and be drawn by suction back into the container when the sidewall again expands.

Another form of the dispensing member comprises a delivery tube communicating with the upright tube in the container and having an exit nozzle or end which is curved in a slightly downward direction. By applying a downward force to the upper part of the delivery tube, the sidewall of the container collapses, decreasing the volume in the interior of the container, thereby causing liquid to be forced up into the tube and then into the delivery tube for discharge therefrom. As the sidewall again expands when the pressure is released, all excess liquid in the delivery tube will be sucked by the expansion of the container back into the latter, thereby assuring substantially no waste of the liquid and preventing the dripping of the liquid at the nozzle.

The primary object of this invention is to provide an improved dispenser which can be hand-actuated, yet will assure substantially no waste while providing positive delivery of liquid each time the dispenser is used.

Another object of this invention is to provide a liquid dispenser of the type described wherein the dispenser has a liquid container provided with a sidewall capable of being collapsed when a downward force is applied to a liquid dispensing member mounted on the upper end of the container so that a liquid will be caused to move out of the container and into the member for discharge therefrom when a slight hand pressure is exerted on the member to collapse the sidewall of the container.

Still a further object of the present invention is to provide a dispenser of the aforesaid character wherein the dispensing member is funnel-shaped to present an upper rim to be engaged by the hand to apply a downward force to collapse the sidewall of the container so that a jet of liquid will spurt up through the member and engage the hand yet excess liquid will gravitate therefrom and will be funneled by the member back to the container to avoid waste.

A further object of this invention is to provide a liquid dispenser in which the dispensing member comprises a delivery tube which, when engaged by the hand and forced downwardly, causes collapse of the sidewall of the container and the liquid dispensed into the delivery tube will be discharged therefrom while excess liquid remaining in the delivery tube will be returned to the container by suction when the sidewall of the container expands following the release of hand pressure from the delivery tube.

Other objects of this invention will become apparent as the following specification progresses, reference being had to the accompanying drawing for an illustration of several embodiments of the invention.

Figure 1:
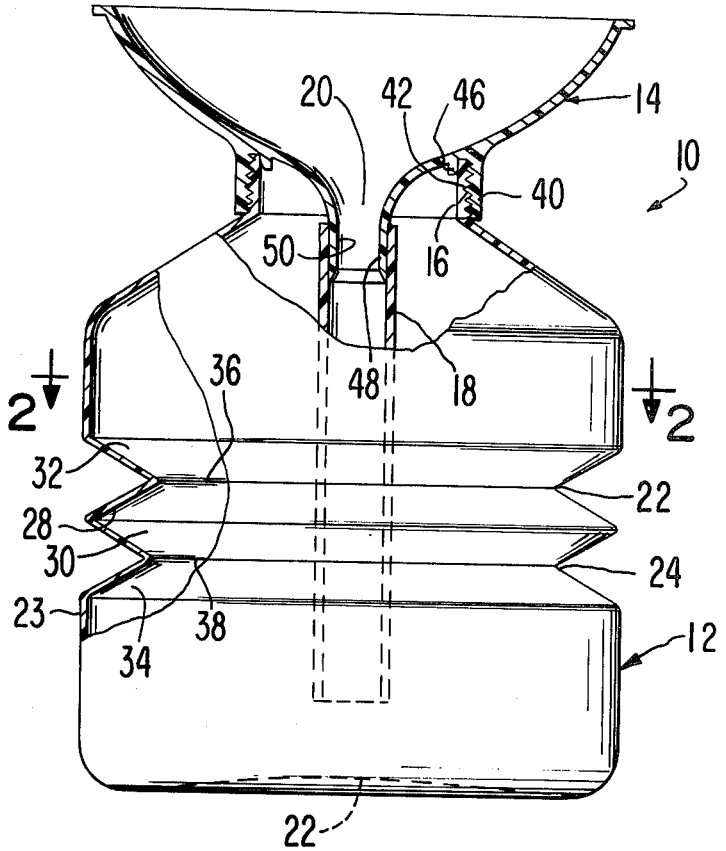
FIG. 1 is a side elevational view, partly in section, of a preferred embodiment of the liquid dispenser of the present invention, showing a cone-shaped top mounted on a liquid container having a corrugated sidewall.
Figure 2:
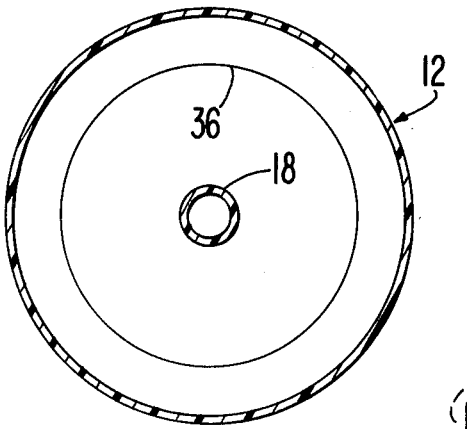
FIG. 2 is a cross-sectional view taken along line 2—2 of FIG. 1.

A preferred embodiment of the liquid dispenser of the present invention is broadly denoted by the numeral 10 and is illustrated in FIGS. 1 and 2. Dispenser 10 includes a liquid container 12, an open top, funnel-shaped member 14 for attachment to the top opening 16 of the container, and a fluid delivery tube 18 extending downwardly from an opening 20 at the lower extremity of member 14 within container 12 to the location near its bottom 22. While FIG. 1 illustrates that the tube 18 is spaced above the bottom, it is clear that the lower open end of the tube could be directly adjacent to the bottom, the only requirement being that liquid in the container is free to enter the lower end of the tube and to travel upwardly therethrough when the container sidewall 23 collapses relative to the bottom in a manner to be described.

The container is generally transversely circular as shown in FIG. 2; however, it can be of other shapes if desired so long as sidewall 23 of the container is allowed to collapse as hand pressure is exerted downwardly on the upper extremity of member 14. To allow collapsing, the container sidewall is provided with one or more corrugations therein so that the sidewall is transversely saw-toothed, rounded or the like. For purposes of illustration, the sidewall has two annular V-shaped grooves 22 and 24 formed therein to present a single corrugation 26 having beveled annular surfaces 28 and 30 which converge with respective beveled annular surfaces 32 and 34 at respective annular boundaries 36 and 38 at the inner extremities of notches 22 and 24. In essence, therefore, surfaces 28, 30, 32 and 34 are conical and are annular in configuration. Thus, when sidewall 23 is in its equilibrium or expanded position of FIG. 1, surfaces 28–34 are relatively far apart; however, when a downward force is applied to the upper extremity of the container, sidewall 23 yields at boundaries 36 and 38 and surfaces 28–34 move toward each other in accordion fashion. When this occurs, the interior of the container is decreased in volume.

Member 14 is generally transversely conical although, as shown in FIG. 1, it has a slight concave portion on its upper or inner surface. Member 14 further has an annular skirt 40 provided with screw threads on the inner surface thereof for threaded engagement with the externally threaded neck 42 defining top opening 20 of container 12. Moreover, member 14 may have an additional annular rib 46 radially spaced inwardly from skirt 40 and adapted to engage in sealing relationship to the inner surface of neck 42 at the upper end thereof. Thus, the junctions between neck 42, skirt 40 and rib 46 can be effectively closed.

Member 14 further has a central, downwardly projecting tubular part 48 extending downwardly from opening 20 thereof, part 48 having a fluid passage 50 therethrough. Tube 18 is press-fitted on projection 48 and communicates therewith. Tube 18 can be rigid or flexible. If flexible, the tube is longer than the distance from part 48 to bottom 22 so that the tube extends toward the junction between bottom 22 and sidewall 23.

The container is preferably blow molded from a suitable plastic material which assures that the container is relatively of thin wall construction yet is relatively self-sustaining, i.e., it normally maintains its shape but it can yield under pressure. This assures that the container will collapse in the manner described above so as to decrease the interior volume thereof.

Member 14 is typically injection molded and is formed from the same material as the material of the container. However, it can be formed of other plastic materials if desired. When member 14 is molded, it can be formed with a sprue 52 (shown in dashed lines in FIG. 1) which covers the upper end of fluid passage 50. This sprue can remain on the top integral therewith until the dispenser 10 is ready for use. Then, it can be broken off and removed and thrown away or the sprue can be inverted and used as a removable stopper to close fluid passage 50.

In use, container 12 is filled with a liquid to be dispensed, such as liquid soap or the like, to a level above the lower open end of the tube 18. Then, when it is desired to dispense the liquid from the container, the hand is placed palm down over the top and a small downward force is exerted by the hand on the top. This causes sidewall 23 of container 12 to collapse through a relatively small distance, such as $\frac{1}{8}$ to $\frac{1}{4}$ inch. As the sidewall collapses, this causes a decrease in the volume of the container, causing liquid to rise in tube 18, to pass through passage 50, and then to spurt or jet upwardly from the open upper end of passage 50. The jet of liquid will travel upwardly far enough to engage the palm of the hand, and a certain amount of the liquid will remain by surface tension on the palm while the remaining liquid will drip back onto the inner surface of the top where the liquid will then gravitate back into the container, thus conserving the excess liquid. The hand can then be removed and the liquid soap on the hand can then be used to cleanse the hand in the normal fashion.

The above-mentioned procedure can be repeated many times because only a very small amount of the liquid is applied to the palm of the hand each time the dispenser is used, and the fluid of the container is such that a relatively large amount of liquid can be put into it. In all cases, the excess liquid will return to the container by way of the conical upper surface of the member 14 thereby preventing waste and effectively storing the unused liquid without creating a messy condition around the bottom of the container.

Figure 3:
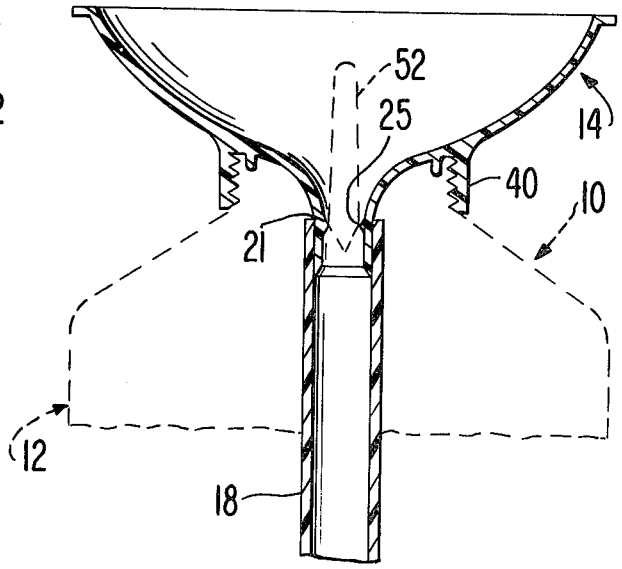
FIG. 3 is a view similar to FIG. 1 but showing a second embodiment of the conical top of the liquid dispenser of FIG. 1.

FIG. 3 illustrates that tube 18 can be formed as an integral part of member 14. In this case, tube 18 is molded directly to the annular boss 21 surrounding the opening 25 in the lower end of member 14.

Figure 4:
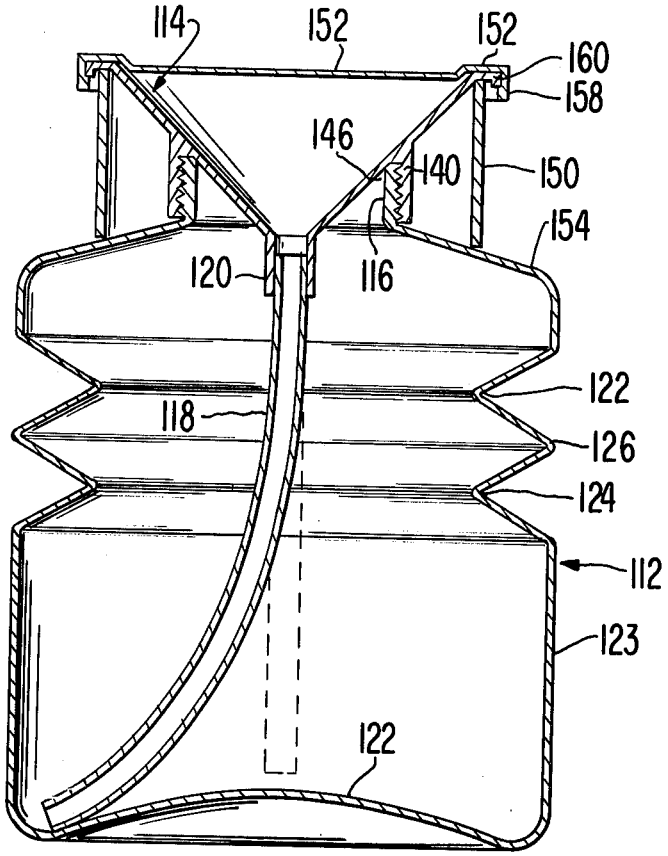
FIG. 4 is a view similar to FIG. 1 but showing a third embodiment of the conical top for the fluid dispenser.

FIG. 4 shows another embodiment of the funnel-shaped dispensing member denoted by the numeral 114. In this embodiment, member 114 has an annular, internally threaded skirt 140 for threaded attachment to the neck 42 of the container, there being an annular rib 146 radially spaced inwardly from skirt 140 for engaging the inner surface of the neck for sealing purposes.

A flexible tube 118 is telescoped within a tubular part 120 at the lower end of member 14. The lower end of tube 118 is near the junction between the bottom 22 and sidewall 23 of container 12.

A second annular skirt 150 is secured to the underside of a lateral, annular flange 152 at the upper, outer periphery or rim of member 114. Skirt 150 can be secured to flange 152 by an adhesive or by sonic welding. The skirt is long enough to extend to the upper surface portion 154 of container 112 when skirt 140 is threaded onto neck 42 and serves to assist in collapsing sidewall 23.

The open top of member 114 can be covered by a removable plastic closure 156 having an annular flange 158 for coupled relationship to an annular bead on the outer periphery of flange 152. Closure 156 is used for shipping or storing the dispenser. Liquid dispenser 10 having member 114 thereon is used in the same manner as described above with respect to liquid dispenser 10 having member 14.

Figure 5:
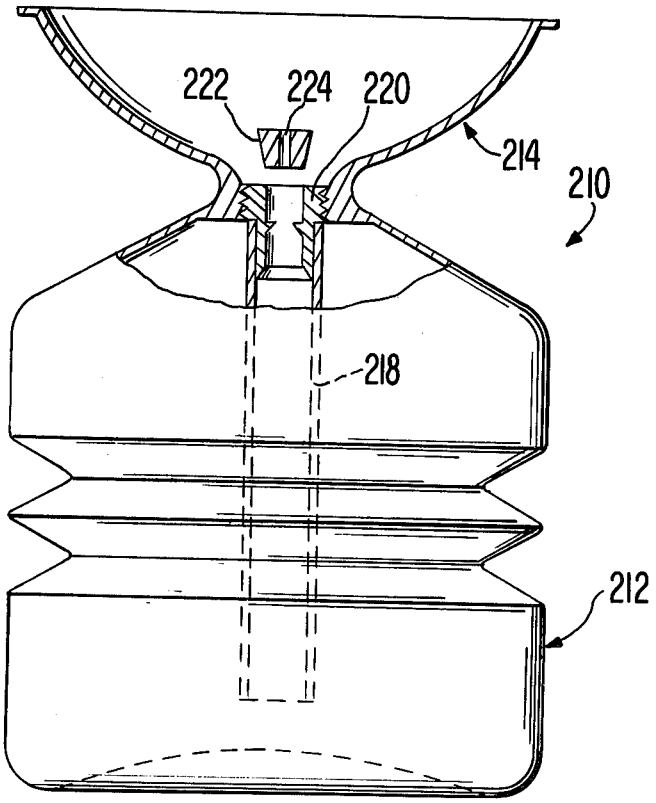
FIG. 5 is a side elevational view, partly in section, showing an embodiment of the liquid dispenser in which both the container and the conical top are integral with each other.

FIG. 5 shows a liquid dispenser 210 in which the liquid container 212 thereof is integral with the funnel-shaped dispensing member 214 at the upper end of the container. To this end, the container has a collapsible sidewall provided with corrugations for permitting the container to collapse and to decrease in volume when hand pressure is applied to the upper rim of member 214.

The junction 216 between container 212 and member 214 is internally threaded so that a tube 218 having external threads 220 thereon can be coupled at this junction. Thus, once the tube is inserted into the passage surrounded by junction 216, threads 220 can engage the threads on the junction so as to hold the tube in an operative position extending into the container. An insert nozzle 222 with a passage 224 therethrough can be press-fitted into the open upper end of tube 218, if desired, to decrease the cross section of the jet of fluid which is directed upwardly when the container is collapsed.

Fluid dispenser 210 is used in the same manner as that described above with respect to fluid dispensers 10 and 110. As is the case with the above-mentioned dispenser 10, dispenser 210 can be re-used if desired by re-filling it after the liquid supply thereof has been used up.

Figure 6:
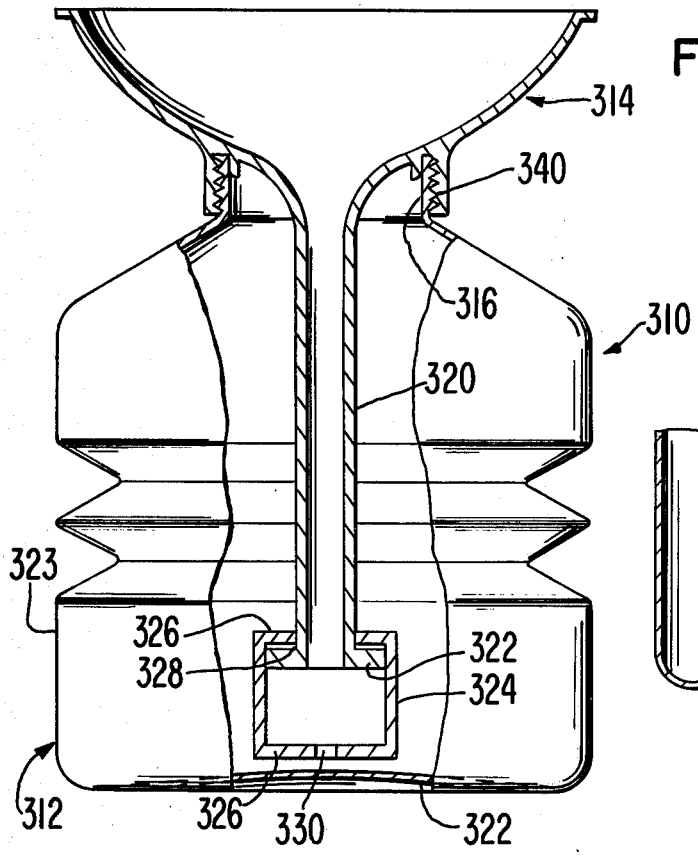
FIG. 6 is a side elevational view, partly in section, of still a further embodiment of the liquid dispenser using a piston and cylinder action to dispense the liquid therefrom, the piston being shown in its uppermost equilibrium position.
Figure 7:
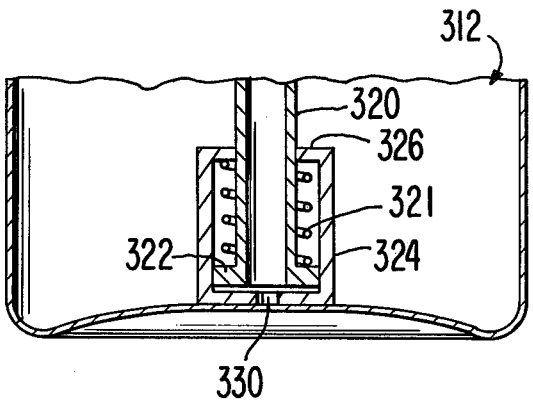
FIG. 7 is a view similar to FIG. 6 but showing the piston in its liquid dispensing position.

Another embodiment of the fluid dispenser of this invention is denoted by the numeral 310 and is illustrated in FIGS. 6 and 7. Dispenser 310 has a liquid container 312 provided with a corrugated sidewall 323 integral with a bottom 322. A funnel-shaped member 314 has an internally threaded skirt 340 inserted on the externally threaded neck 316 of container 312 to close the open top thereof.

Member 314 has a tube 320 extending downwardly therefrom and terminating at a piston 322 at its lower end. The piston is in sliding engagement with the inner walls of a tubular, shiftable housing 324 having a top 326 either press-fitted or threaded thereon to confine the piston therein. Top 326 has an opening 328 therethrough so that tube 320 can project upwardly from piston 322 to member 314. A coil spring 321 biases piston 322 downwardly to assist its pumping action, but the restoring force of the spring is not great enough to prevent the sidewall from returning to its equilibrium condition after it has been collapsed.

Housing 324 has an opening 330 in its bottom to allow liquid to enter the housing and fill the same. When hand pessure is exerted on the upper rim of member 314, sidewall 323 will collapse as described above with respect to the other dispenser embodiments and piston 322 will travel downwardly in housing 324. This will cause the housing to move downwardly into engagement with bottom 322 as shown in FIG. 7 to close opening 330. At the same time, the piston moves downwardly in the housing and forces the liquid in the housing upwardly in the form of a jet from the upper end of tube 320. The liquid will then engage the palm of the hand and excess liquid will drip back into the housing. This embodiment is used when a predetermined volume of the liquid is to be dispensed each time the hand pressure forces member 314 downwardly relative to container 312.

Figure 8:
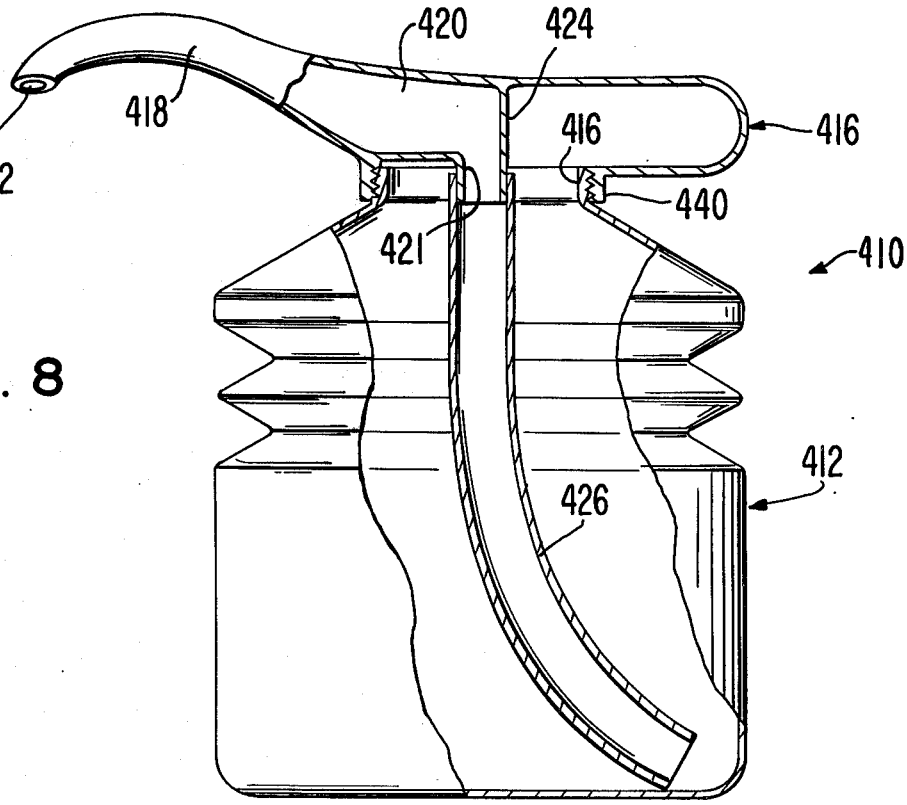
FIG. 8 is a side elevational view, partly in section, of a liquid dispenser having a transverse delivery tube rather than a conical top as shown in the previous embodiments.

Another embodiment of the invention is shown in FIG. 8 in which the container is the same as that described above with respect to the other dispenser embodiments but the dispensing member is of a different configuration. To this end, the dispenser 410 has a container 412 and a tubular dispensing member 414 having an annular internally threaded skirt 440 for threaded engagement with the neck 416 of the container.

Member 414 has an inclined fluid passage 420 therethrough extending upwardly and outwardly from a central opening 421. An inclined, downwardly directed exit end 422 is on the outer end of member 414 in fluid communication with passage 420. A tubular projection 424 is formed on member 414 within the skirt 440 thereof and surrounds opening 421 so that a tube 426 can be press-fitted onto projection 424 and thereby communicate with passage 420 by way of opening 421.

In use, hand pressure on member 414 causes the sidewall of the container to collapse, thereby forcing liquid upwardly through tube 426 and into passage 420 due to the decrease of volume in the container. The liquid will then be dispensed through member 414 and outwardly from end 422. When the hand pressure is removed, member 414 moves upwardly due to the expansion of the sidewall of the container and suction will draw all excess liquid in fluid passage 420 back into the container. Thus, there will be no dripping of liquid at end 422.

Figure 9:
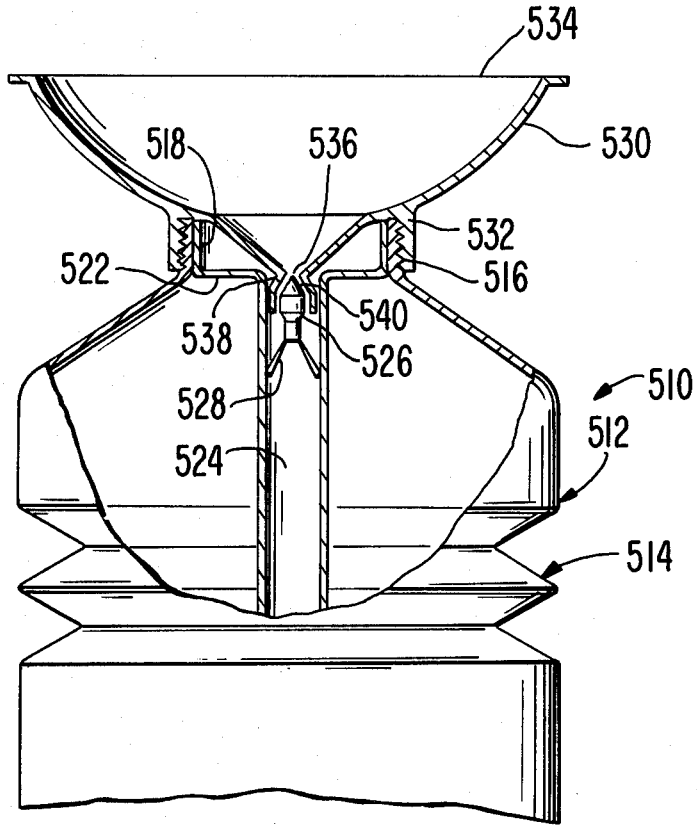
FIG. 9 is a side elevational view, partly in section, of an embodiment having an adjustable needle valve to meter the fluid flow thereof.

A further embodiment of the fluid dispenser is shown in FIG. 9 and is denoted by the numeral 510. Dispenser 510 includes a liquid container 512 having a collapsible sidewall 514 similar to the other embodiments mentioned above. The container has an externally threaded neck 516 and a generally annular flange 518 surrounding the opening 520 at the top thereof. A flange 522 having a tube 524 thereon is removably supported on flange 518. Tube 524 has a fixed needle valve 526 mounted therein near the normally upper end thereof by a spider comprised of three spaced legs 528, the spacing being sufficient to allow liquid to pass between the legs and upwardly through the remainder of the tube.

A funnel-shaped top member 530 has an annular flange 532 which is threadably mounted on neck 516. Member 530 has an upper, continuous rim 534 adapted to be engaged by the hand and to be forced downwardly to cause collapse of sidewall 514 to decrease the volume of container 512 for the reasons mentioned above with respect to te other embodiments. Member 530 further has a central opening 536 and a tubular part 538 defining a throat 540 into which valve 526 can extend. The valve has a conical upper surface and throat 540 is transversely circular so that the greater the amount by which valve 526 projects into throat 540, the more the throat will be closed off. Adjustment of the effective cross section of throat 540 is accomplished by rotating member 530 and thereby flange 532 thereof relative to container neck 516. Depending upon the direction of rotation, part 538 can be raised or lowered relative to valve 526 and thereby control the cross section of throat 540.

In use, with the proper setting of the throat size, fluid dispenser 510 is actuated in the same manner as the dispensers of the previously mentioned embodiments.

Figure 10:
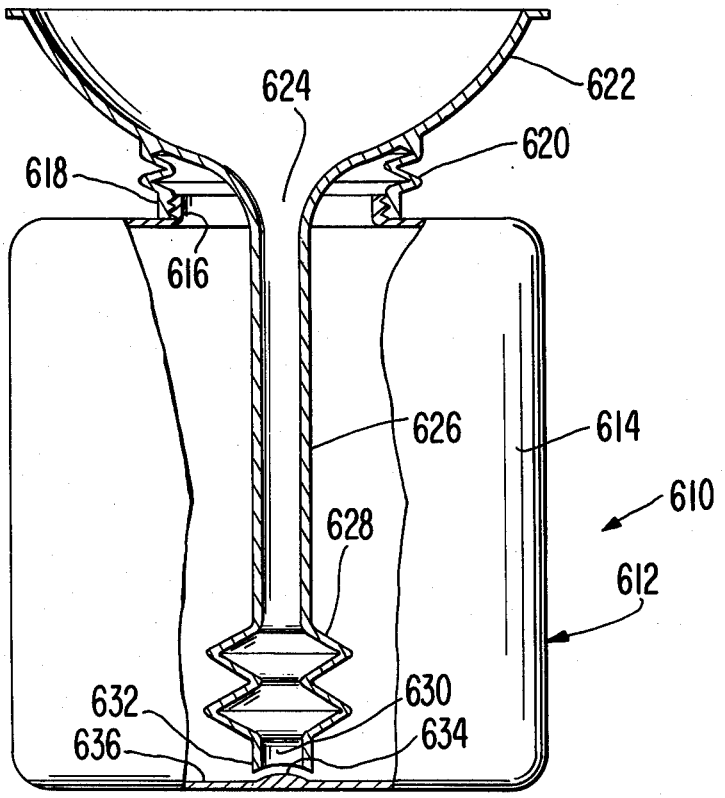
FIG. 10 is a side elevational view, partly in section, of an embodiment similar to the embodiments of FIGS. 6 and 7 but showing a bellows instead of a piston and cylinder.

FIG. 10 shows another embodiment of the fluid dispenser, denoted by the numeral 610. It has a fluid container 612 provided with a continuous, uninterrupted sidewall 614 which has no corrugations as described above with respect to the previous embodiments. Container 612 has a neck 616 which is externally threaded to receive an annular flange 618 on the neck 620 of a funnel-shaped top member 622. Neck 620 has one or more corrugations formed therein to permit collapse of neck 620 relative to container neck 616. The corrugation of neck 620 has the same configuration as the corrugation of the containers of previous embodiments, such as the embodiment of FIG. 1.

Funnel-shaped member 622 has a central opening 624 and a tube 626 depending from opening 624, the lower end of tube 626 having a bellows 628 provided with a bottom opening 630. Lower end 632 of the bellows is adapted to engage a spherical surface 634 on the bottom 636 of container 612 when hand pressure forces member 622 downwardly to cause collapse of neck 620. When this occurs, lower end 632 engages surface 634 and continued downward movement on member 622 will cause collapse of bellows 628. This will decrease the combined volume of tube 626 and bellows 628, thereby forcing liquid upwardly through the bellows and tube and to spurt upwardly through opening 624 in a jet action and into engagement with the hand. Opening 630 is closed and member 632 engages surface 634. Release of the hand pressure allows neck 620 to expand to its equilibrium condition and allows bellows 628 to return to its normal condition.

To hold the container of any of the liquid dispensers described above to a supporting surface, releasable suction cup means can be used on the container. Also, the rim on the upper extremity of the dispensing member, such as member 14 of FIG. 1, can be serrated or scalloped to prevent the hand from completely closing the open top of the member.

I claim:

1. A liquid dispenser comprising: a container having a corrugated sidewall and a top opening, said container adapted to contain a liquid to be dispensed; a dispensing member having an open top and mounted on the container adjacent to the top opening thereof, the member having an upper hand-engageable rim extending about said open top thereof, a fluid passage therethrough centrally disposed at the bottom thereof for communicating with said container through said top opening, and an inner surface having a downward slope extending throughout a major part of the distance between the rim and the fluid passage and terminating at said fluid passage, said rim having a transverse dimension substantially corresponding to at least a major part of the transverse dimension of a user's palm; and a tube extending downwardly from the fluid passage into the container below the liquid level thereof, said sidewall being collapsed when a sudden downward force is exerted by the hand while substantially covering the rim of the member to thereby reduce the volume of the container to cause a portion of the liquid to be forced upwardly through the tube and the fluid passage of the member and out of said fluid passage in the form of a jet onto the hand, the size and shape of the member being sufficient to permit substantially all excess liquid gravitating from and deflected by the hand to be returnable to said flange passage, said tube and the container by movement downwardly along said inner surface.

2. A liquid dispenser as set forth in claim 1, wherein said container has an upper surface near the open top therein, and including an annular skirt extending downwardly from the rim of the member and having a lower margin in proximity to the upper surface of the container.

3. A liquid dispenser as set forth in claim 1, wherein is included a top closure engageable with the rim of the member and releasably coupled thereto for covering the top of the member.

4. A liquid dispenser as set forth in claim 1, wherein the member has a hole therethrough at one end of the fluid passage, said tube being integral with the member and communicating with the hole.

5. A liquid dispenser as set forth in claim 1, wherein is included a tubular housing in the container, the housing having a bottom provided with an opening therethrough, said tube extending into said housing and having a piston thereon with the piston being in sliding engagement with the inner surface of the housing, the bottom of the housing being normally out of engagement with the bottom of the container when the container sidewall is in an uncollapsed condition, the housing bottom being movable into engagement with said container bottom when the sidewall is collapsed to close the opening in the housing bottom.

6. A liquid dispenser as set forth in claim 1, wherein is provided means defining a throat adjacent to the junction of said container and said member, and valve means extending into the throat, there being means coupled with the valve for adjusting its position in the throat to thereby vary the effective cross section of the throat.

7. A liquid dispenser as set forth in claim 6, wherein said valve is carried by the tube, said member having means therein for defining said throat, said member being threadably mounted on said container, the threaded connection between the member and the container defining said adjusting means.

8. A liquid dispenser as set forth in claim 1, wherein the member is integral with the container at the upper end thereof, said tube having means on the upper end thereof for mounting the same on the container at the junction thereof with said member.

9. A liquid dispenser as set forth in claim 1, wherein said dispensing member has an annular, collapsible neck, the lower end of the tube having a bellows thereon, said bellows having a lower open end normally spaced from the bottom of the container, said lower open end being movable into engagement with the container bottom to close said lower open end when a hand-actuated force is exerted on said rim to cause collapse of the neck of said member.

10. A liquid container comprising: a container having a bottom, a sidewall integral with the bottom and extending upwardly therefrom, and a neck provided with a hole therethrough, said sidewall having at least a pair of grooves therein with each pair of grooves defining a corrugation therebetween, the container being formed of a material permitting the corrugation to yield at the extremities thereof to thereby permit collapse of the sidewall and a decrease in the interior volume of said container when a downward force is exerted on said container; a dispensing member having an annular, externally threaded skirt for threaded attachment to the neck of said container, said member having a central opening near the lowermost extremity thereof, a circular rim at its upper extremity, and a downwardly sloping inner surface extending throughout a major part of the distance between said central opening and the rim, said rim being engageable by the palm of the hand to force said member downwardly to cause collapse of said sidewall, said rim having a diameter substantially corresponding to at least a major part of the transverse dimension of a user's palm; and a tube communicating with the opening in the member and extending downwardly therefrom into said container toward the bottom thereof, said tube being adapted to convey liquid upwardly from said container through said central opening and through the interior of said member in the form of a jet when a sudden downward force on said member by the hand while substantially covering causes collapse of said sidewall, the diameter of the rim and the depth of the interior of said member being sufficient to permit substantially all excess liquid gravitating from and deflected by the hand to be returned to said central opening, said tube and the container by movement downwardly along said inner surface.

* * * * *